US009364056B1

(12) United States Patent
Azar et al.

(10) Patent No.: US 9,364,056 B1
(45) Date of Patent: Jun. 14, 2016

(54) JEWELRY ARTICLE

(71) Applicant: HB CONCEPTS, LLC, Springfield, MA (US)

(72) Inventors: Petra Azar, New Hope, PA (US); Camile Hannoush, Springfield, MA (US)

(73) Assignee: HB Concepts, LLC, Springfield, MA (US)

( * ) Notice: Subject to any disclaimer, the term of this patent is extended or adjusted under 35 U.S.C. 154(b) by 125 days.

(21) Appl. No.: 14/044,930

(22) Filed: Oct. 3, 2013

(51) Int. Cl.
*A44C 13/00* (2006.01)
*A44C 5/20* (2006.01)
*A44C 25/00* (2006.01)

(52) U.S. Cl.
CPC ..... *A44C 25/001* (2013.01)

(58) Field of Classification Search
None
See application file for complete search history.

(56) References Cited

U.S. PATENT DOCUMENTS

| | | | | |
|---|---|---|---|---|
| 5,157,945 | A | 10/1992 | Giehl | |
| 7,654,110 | B2 | 2/2010 | Azar | |
| 7,950,117 | B2 | 5/2011 | Elhaj | |
| 2002/0108217 | A1* | 8/2002 | Cogdill | 24/303 |

OTHER PUBLICATIONS

Stainless steel heart-shaped couple pendant—gender symbols (admitted art) http://jewellery-eshop.eu/Home/4360-stainless-steel-heart-shaped-couple-pendant-gender-symbols.html.

Steel dvojprivesok heart—Inserted zirconia (admitted prior art) http://sperky-eshop.sk/4353-ocelovy-dvojprivesok-srdce-vkladana-zlrkony.html.

Couples Split Heart Puzzle Pendant Set (admitted prior art) http://www.personalized-jewelry.com/ProductDetail/Couples-Split-Heart-Puzzle-Pendant-Set-100275.html.

Pendants for lovers—split matt heart, romantic inscription (admitted prior art) http://jewelry-eshop.com/7162-pendants-for-lovers-split-matt-heart-romantic-inscription.html.

Stainless steel couples pendant—Absorbent symbols and spiral (admitted art) http://ekszer-eshop.hu/7897-nemesacel-medal-paroknak-felszivek-szimbolumokkal-es-spirallal.html.

* cited by examiner

*Primary Examiner* — Jack W Lavinder
(74) *Attorney, Agent, or Firm* — Levisohn Berger LLP

(57) ABSTRACT

A pendant formed of separable segments along a substantially diagonal line in which the segments have a mechanical interlock formed of a member physically attached to the rear portion of one of the segments and having a tab which fits into a recess formed in the rear of the second of said tabs such as the segments may not be physically separated in the horizontal direction one from the other.

4 Claims, 2 Drawing Sheets

JEWELRY ARTICLE

BACKGROUND OF THE INVENTION

The invention relates to a new and novel jewelry article in which a pendant is made as separable elements, and the pendant serves as a clasp closing the pendant and attached chain.

Jewelry chains have long been known, and they have various forms of clasps to open and close them. These are often small, hard to use or manipulate, often requiring the assistance of another party to attach or remove the chain from the wearer.

The inventor herein is the inventor of prior U.S. Pat. No. 7,654,110, which shows a variety of embodiments in which a pendant is split into segments and connectable by magnetic elements, allowing the pendant to serve as both the clasp and pendant when there is a chain attached to the segments.

It has been found by the inventor that integrating a mechanical interlock in a hidden manner with the magnetic attachment means described in the '110 patent provides a substantially foolproof method and apparatus allowing the pendant to both serve as a pendant and clasp and have the attachment of the segments be most secure.

An object of this invention is to provide an improved jewelry item in which a clasp is more easily handled by the wearer.

Still another object of this invention is to provide a clasp for a split pendant in which the split pendant serves as a clasp when attached to a chain but the split members are together with a mechanical interlock ensuring the pieces remain together.

Yet another object of this invention is to provide such mechanical interlock in which horizontal pulling apart of the split pendant members is prevented.

Other objects, advantages and features of this invention will become more apparent from the following description.

SUMMARY OF THE INVENTION

In accordance with the principles of this invention, the above objects are providing a mechanical interlock between two connected split jewelry segments with the orientation of the interlock being such that separation of the segments is prevented. The segments together form a pendant, and when the segments are attached to a chain also serve as a clasp. The mechanical interconnection locking the members together is formed along a diagonal orientation to function as a locking mechanism and is hidden in ordinary view located substantially on the rear portion of the pendant. Independent of whether or not magnetic connecting members are employed, the mechanical interlock hidden in the rear of the pendant design ensures the pendant segments are not able to be separated horizontally and serve both as the clasp and the rear portion of the pendant as it is worn.

DETAILED DESCRIPTION OF PREFERRED EMBODIMENTS

Figure 1:
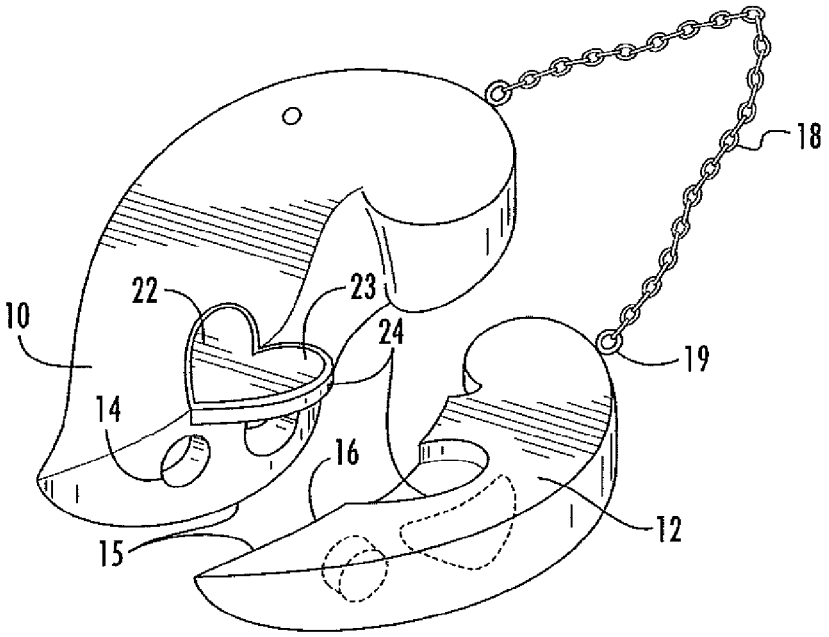
FIG. 1 is a rear perspective view of two segments of a pendant design shown apart.
Figure 2:
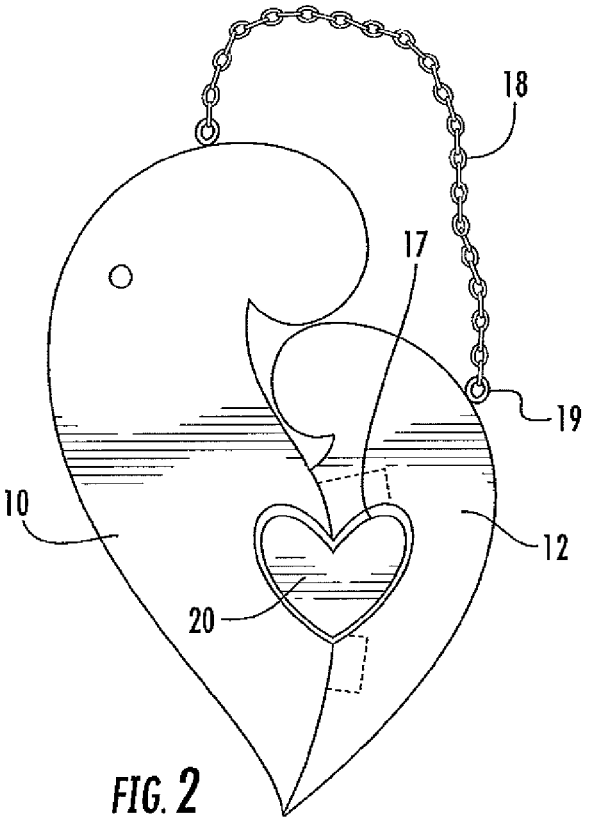
FIG. 2 is a rear plan view of the invention of FIG. 1 with the segments connected.
Figure 3:
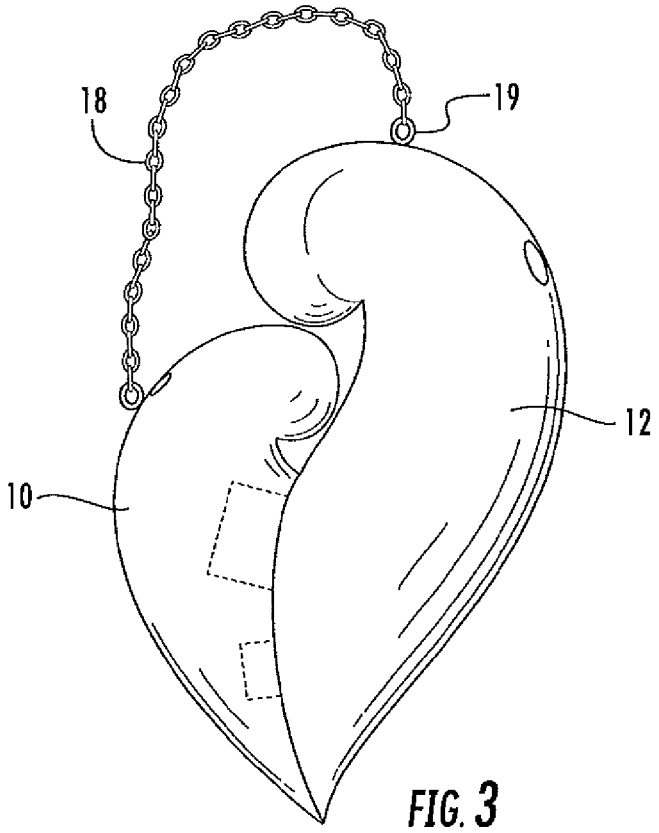
FIG. 3 is a front view of the pendant design of FIG. 2.

FIGS. 1-3 show two separated segments 10 and 12 of a pendant having magnetic attraction elements 14 and 16 embedded in the facing surfaces or portions 15 of segments 10 and 12, respectively. The magnetic elements and the mating segments are described in more detail in my prior U.S. Pat. No. 7,654,110. Each of the pendant segments is attached at connector ring 19 to a chain 18 so that the pendant can be assembled as the clasp closing the jewelry chain 18.

A mechanical interlock member 20 is formed by a heart shaped interconnecting element 22 fixedly secured to segment 10 and having a tab 23 suitable for fitting into a recess 24 in segment 12. When element 22 fits into recess 24, pendant segments 10 and 12 are interlocked mechanically as well as held magnetically through elements 14 and 16. The acute angle formed by the right side 23 or tab 23 of the heart shaped interconnecting element is steep enough to prevent mechanical horizontal separation of elements 10 and 12. In essence, the acute angle forms a diagonal orientation of the seam between segments 10 and 12, and the diagonal orientation prevents any substantially horizontal separation of the elements.

FIGS. 2 and 3 show the rear and front plan views of the pendant shown in FIG. 1 with the segments 10 and 12 together having a diagonal seam 17 therebetween. In normal use, interconnecting element 22 is hidden and not seen by the ordinary observer, although its utilization by the wearer is clear merely by pressing tab 23 into recess 24 to interlock the two segments 10 and 12.

Magnetic elements 14 and 16 help guide the two segments 10 and 12 toward each other which are then securely attached to a mechanical interlock 22 in recess 24.

Figure 4:
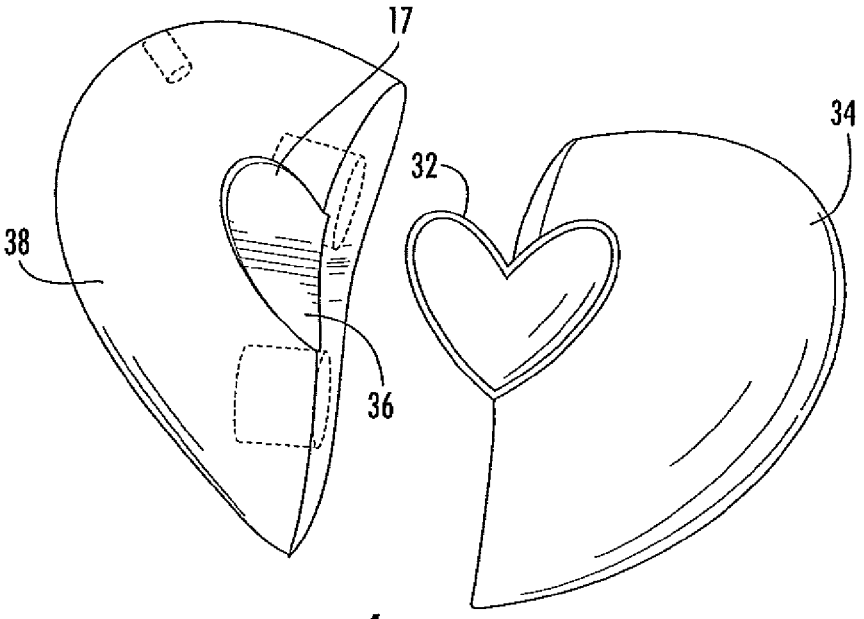
FIG. 4 is a rear plan view of another embodiment of the invention showing the pendant segments separated with the interlocking mechanical part shown fixedly attached to one of the segments.

FIG. 4 shows a rear view of another embodiment of this invention in which another heart projection 32 is attached at the rear of a segment 34 allowing heart projection 32 to fit into recess 36 of segment 38 thereby mechanically connecting the segments together. The diagonal seam line 17 is shown in the recess 36. The angle of the projecting left portion of projection 32 is sufficiently acute to prevent horizontal separation of members 34 and 38.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. A pendant/clasp serving concurrently as both a pendant and a clasp, said pendant/clasp comprising at least two segments which together form said pendant/clasp, said pendant/clasp having a front and a rear when said segments are connected together, each of said segments having a facing surface facing the other of said segments whereby said segments are connected together to form said pendant/clasp with a seam line between said segments, magnetic members located in the facing surfaces of said segments magnetically attached to each other as said segments are joined together, a substantially heart-shaped mechanical interlock member formed into the rear pendant/clasp to hide said mechanical interlock member from the front of the pendant/clasp when the two segments are connected to one another, said substantially heart-shaped mechanical interlock member having a single tab of uniform thickness which protrudes from one of the facing surfaces of said segments toward the other segment and a complementary recess in said other segment into which said tab fits, said recess having a single continuous uniform depth without any protrusions located within the recess when disengaged from the tab, said recess extending from said rear partially toward said front of said pendant/clasp, and said tab being of substantially the same thickness as the depth of said recess so that the rear surface of said substantially heart-shaped mechanical interlock and said rear of said pendant/clasp are substantially coplanar at their junction.

2. A pendant/clasp according to claim 1, wherein said interlock member is heart shaped and the shape of said recess conforms to the tab of said heart shaped interlock member.

3. A pendant/clasp according to claim 1, further comprising an open chain having two ends, each of said ends mechanically connected to respective tops of said segments.

4. The pendant/clasp according to claim 2, further comprising an open chain having two ends, each of said ends mechanically connected to respective tops of said segments.

* * * * *